US009540935B2

(12) United States Patent
Perdrigeon et al.

(10) Patent No.: US 9,540,935 B2
(45) Date of Patent: Jan. 10, 2017

(54) FAN ROTOR AND ASSOCIATED TURBOJET ENGINE

(75) Inventors: Christophe Perdrigeon, Ballainvilliers (FR); Laurent Jablonski, Melun (FR); Philippe Gerard Edmond Joly, Vaux le Penil (FR)

(73) Assignee: SNECMA, Paris (FR)

( * ) Notice: Subject to any disclaimer, the term of this patent is extended or adjusted under 35 U.S.C. 154(b) by 770 days.

(21) Appl. No.: 13/983,241

(22) PCT Filed: Feb. 20, 2012

(86) PCT No.: PCT/FR2012/050357

§ 371 (c)(1),
(2), (4) Date: Aug. 1, 2013

(87) PCT Pub. No.: WO2012/114032

PCT Pub. Date: Aug. 30, 2012

(65) Prior Publication Data

US 2013/0315744 A1 Nov. 28, 2013

(30) Foreign Application Priority Data

Feb. 21, 2011 (FR) ..... 11 51401

(51) Int. Cl.
*F01D 5/30* (2006.01)
*F04D 29/32* (2006.01)

(52) U.S. Cl.
CPC ..... *F01D 5/3069* (2013.01); *F01D 5/3015* (2013.01); *F04D 29/321* (2013.01); *F04D 29/322* (2013.01); *F05D 2220/36* (2013.01)

(58) Field of Classification Search
CPC .... F01D 5/3007; F01D 5/3015; F01D 5/3069; F01D 5/326; F04D 29/321; F04D 29/322; F04D 29/325; F04D 29/326; F04D 29/329; F04D 29/34; F04D 29/646; F05D 2220/36; F05D 2230/64
(Continued)

(56) References Cited

U.S. PATENT DOCUMENTS 3,799,693 A * 3/1974 Hull ..... F02C 7/04 244/53 B
4,393,650 A * 7/1983 Pool ..... F02C 7/047 416/132 R
(Continued)

FOREIGN PATENT DOCUMENTS

| | | |
|---|---|---|
| EP | 0 091 865 | 10/1983 |
| EP | 1 357 254 | 10/2003 |
| EP | 1 746 250 | 1/2007 |

OTHER PUBLICATIONS

International Search Report Issued Apr. 18, 2012 in PCT/FR12/050357 Filed Feb. 20, 2013.

*Primary Examiner* — Craig Kim
*Assistant Examiner* — Alexander White
(74) *Attorney, Agent, or Firm* — Oblon, McClelland, Maier & Neustadt, L.L.P.

(57) ABSTRACT

A fan rotor including a disk carrying blades including roots engaged in slots in the disk, a frustoconical cap mounted on the disk upstream from the blades, and a retaining mechanism axially retaining the blades on the disk and including a ring mounted in an annular groove of the disk and forming an abutment for the roots of the blades, the ring being festooned or crenellated and co-operating with a festooned radial annular bead of the annular groove of the disk, and a mechanism preventing the ring from moving in rotation, which includes an annulus carrying at least one axial tooth inserted in hollow portions of the bead of the disk and of the ring, the annulus being fastened by bolts on an upstream radial face of the disk.

5 Claims, 4 Drawing Sheets

(58) Field of Classification Search
USPC ..... 416/214 R, 219 R, 220 R, 245 R
See application file for complete search history.

(56) References Cited

U.S. PATENT DOCUMENTS

| | | | | |
|---|---|---|---|---|
| 4,470,756 | A | 9/1984 | Rigo et al. | |
| 6,595,755 | B2 * | 7/2003 | Brioude | F01D 21/045 416/220 R |
| 6,951,448 | B2 * | 10/2005 | Duesler | F01D 5/326 416/220 R |
| 7,303,377 | B2 * | 12/2007 | Rockarts | F01D 5/027 416/144 |
| 2003/0194318 | A1 | 10/2003 | Duesler et al. | |
| 2007/0020089 | A1 | 1/2007 | Forgue et al. | |
| 2010/0051112 | A1 * | 3/2010 | Dieling | F02C 7/04 137/15.1 |
| 2011/0236217 | A1 * | 9/2011 | Bottome | F04D 29/321 416/245 R |

* cited by examiner

FAN ROTOR AND ASSOCIATED TURBOJET ENGINE

The present invention relates to a fan rotor, in particular for a turbine engine.

The rotor of a fan of a turbine engine comprises a disk carrying blades at its outer periphery, the blades having roots that are engaged in substantially axial slots in the outer periphery of the disk. The blades are held radially on the disk by co-operation between the shapes of their roots and the shapes of the slots in the disk, the blade roots being of the dovetail type, for example. Interblade platforms are mounted on the disk between the blade roots. The disk is generally fitted with balance weights that extend radially inwards.

In the prior art, the blades are held axially on the disk by means that are mounted on the disk both upstream and downstream from the blades and that serve to prevent the blade roots from moving axially in the slots in the disk.

By way of example, the holder means situated downstream from the blades comprise at least one hook that is engaged in notches machined in the downstream end portions of the blade roots.

By way of example, the holder means that are situated upstream comprise a spring and an annular plate fitted onto the upstream end of the disk and fastened thereto. The ring is mounted on the same axis as the disk and includes a festooned portion that co-operates with a corresponding festooned portion of the disk. The plate is mounted on the same axis as the disk so as to prevent the ring from moving axially on the disk and it is prevented from turning relative to the disk. The outer periphery of the plate bears axially against the blade roots in order to retain them axially in an upstream direction, its inner periphery being pressed against and fastened to a corresponding annular flange of the disk. The outer periphery of the plate also has attachment pegs for attaching the upstream ends of the interblade platforms.

A shroud of substantially frustoconical shape mounted on the disk upstream from the blades serves to define the inside of the annular passage for admitting air into the engine. In the vicinity of its downstream end, this shroud has a radially inner annular flange that is pressed against the above-mentioned plate and that is fastened together with the plate on the flange of the disk by bolts.

A frustoconical cap is also mounted on the above-mentioned shroud, on its upstream portion, by means of other bolts that are engaged in holes in the flanges of the cap and of the shroud and that are situated radially inside the bolts for fastening the shroud on the disk.

Such a structure cannot be used when the fan is of small diameter. There is not sufficient radial space for housing all of the above-mentioned bolts and flanges. In particular, it is difficult to house the bolts and the flanges that are used for fastening the cap to the shroud.

Furthermore, the disk is fastened to a drive shaft by means of a nut screwed onto the shaft. In order to be able to assemble and disassemble the fan rotor, it is necessary to be able to access this nut axially with a tool. For this purpose, the operator needs to have sufficient space available around the central axis.

When the fan is of small diameter, the above-described prior art structure cannot give access to the above-mentioned central nut.

Document EP 1 357 254 also discloses a fan rotor of structure that presents significant radial and axial extent.

A particular object of the invention is to provide a solution to this problem that is simple, effective, and inexpensive.

To this end, the invention provides a fan rotor in particular for a turbine engine, the rotor comprising a disk carrying blades having roots engaged in substantially axial slots in the outer periphery of the disk, a substantially frustoconical cap mounted on the disk upstream from the blades, and retaining means for axially retaining the blades on the disk and comprising a ring mounted in an annular groove of the disk and forming an abutment for the roots of the blades, the ring being festooned or crenellated and co-operating with a festooned radial annular bead of the annular groove of the disk, and means for preventing the ring from moving in rotation, which means comprise an annulus carrying at least one axial tooth inserted in hollow portions of the bead of the disk and of the ring, the annulus being fastened by bolts on an upstream radial face of the disk, the rotor being characterized in that the annulus includes lugs extending radially inwards and formed with holes for passing axial bolts for fastening the annulus on the disk, the above-mentioned cap being fastened on the disk by axial bolts passing through the holes in some of the lugs of the ring.

In this way, certain bolts of the annulus pass bolts that are used for fastening the cap and the annulus on the disk while other lugs of the annulus pass bolts that are used solely for fastening the annulus on the disk.

These bolts are situated on substantially the same diameter, so that the overall radial size of the assembly is reduced. It is thus possible to leave free a central space that is large enough to access the nut for fastening the disk on the shaft of engine.

Furthermore, when the cap is made of a light material such as aluminum, there is a risk of the cap being torn off, e.g. as a result of a bird being ingested in the fan.

Under such circumstances, tearing off the cap cannot lead to the annulus and the disk becoming separated. Tearing off the cap has no effect on the bolts that serve solely for fastening the annulus on the disk. This thus avoids any loss of the ring for holding the blades axially and thus any accidental ejection of one or more blades of the fan.

According to another characteristic of the invention, in its middle portion, the cap includes an inner annular bead having both blind axial holes formed therein that open out downstream and that serve as housings for heads of the bolts for fastening the annulus on the disk, and also through axial holes for passing bolts for fastening the cap on the disk.

Advantageously, an indexing peg is mounted in the aligned holes in the annulus and in the disk and includes an upstream head received in a blind hole in the inner radial bead of the cap.

The cap may be fitted with balance screws extending radially and screwed into tapping in the cap. The indexing peg serves to guarantee that the balance screws are properly positioned angularly on the fan rotor, in the event of the cap being removed and reassembled.

According to a possibility of the invention, the inner bead of the cap has two through axial holes that are tapped for passing extractor screws.

Furthermore, the cap may be made of light metal, e.g. of aluminum, and the annulus may be made of metal that withstands being torn away, e.g. high alloy steel.

The invention also provides a turbojet, characterized in that it includes a fan rotor of the above-specified type.

The invention can be better understood and other details, characteristics, and advantages thereof appear more clearly on reading the following description made by way of non-limiting example and with reference to the accompanying drawings, in which.

Figure 1:
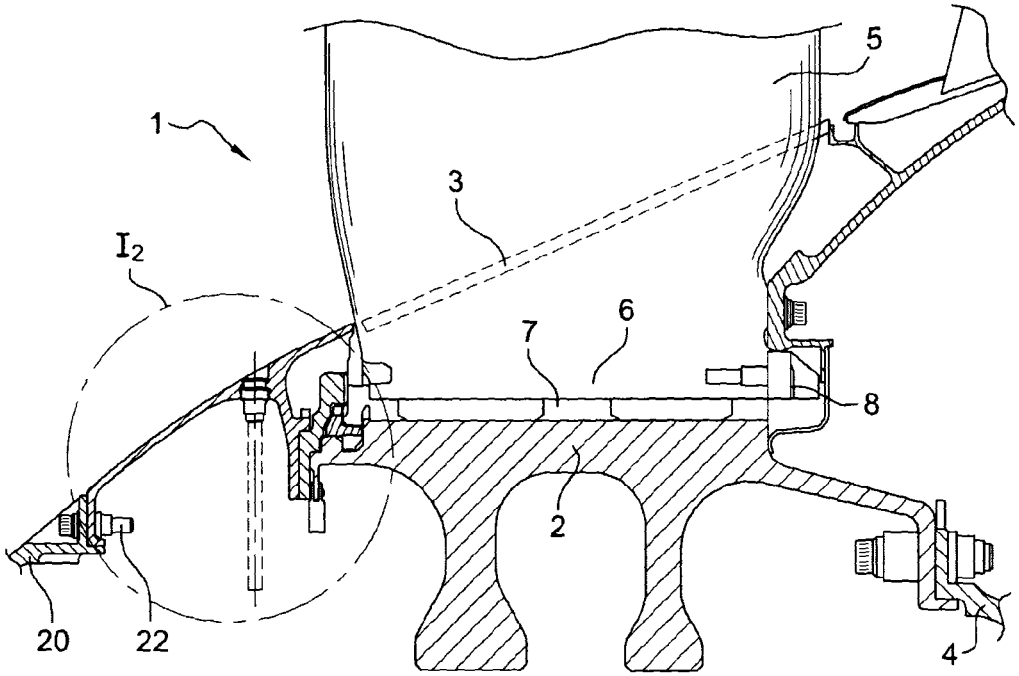
FIG. 1 is a fragmentary diagrammatic half-view in axial section of a prior art turbine engine fan.
Figure 2:
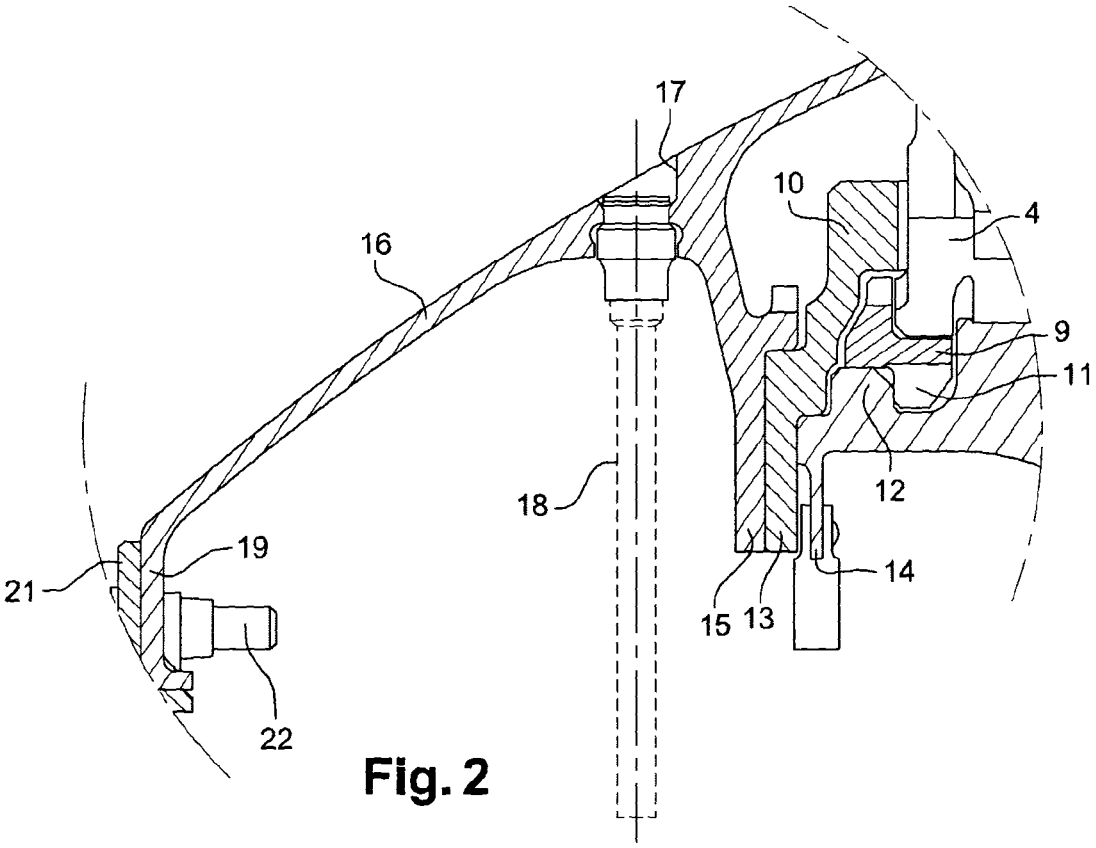
FIG. 2 is a view on a larger scale showing a detail $I_2$ of FIG. 1.
Figure 3:
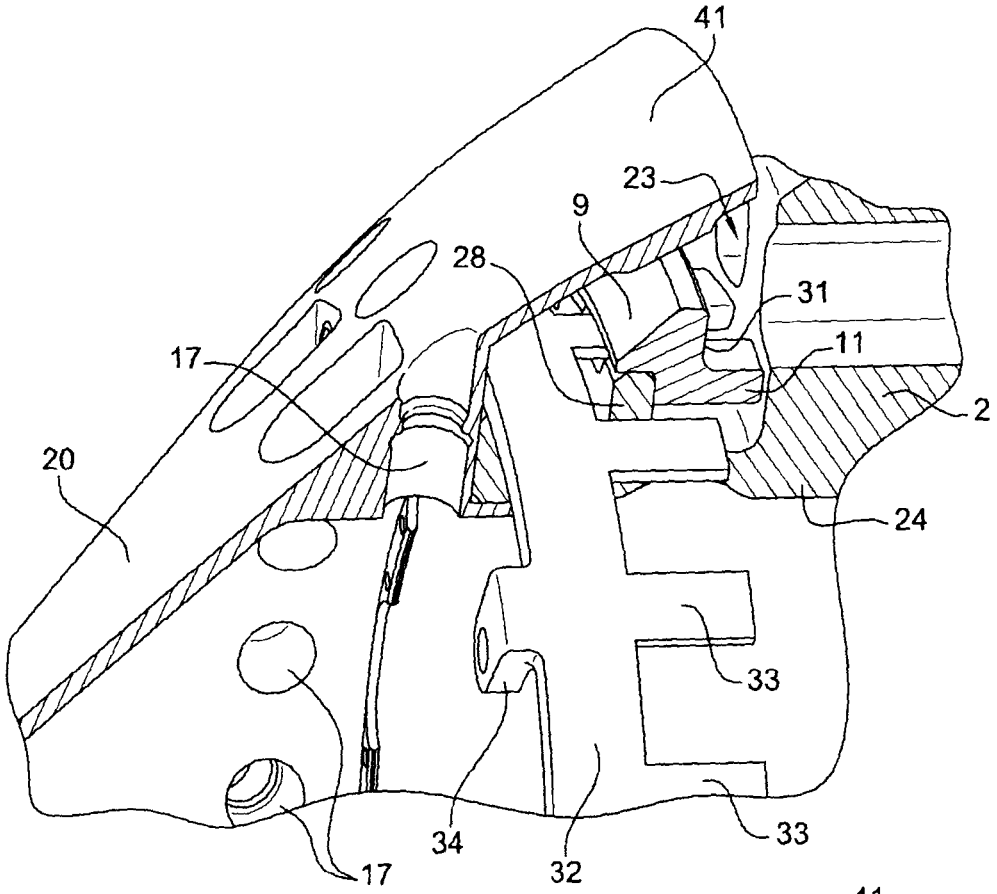
FIGS. 3 and 4 are perspective views of a portion of a fan rotor of the invention.
Figure 4:
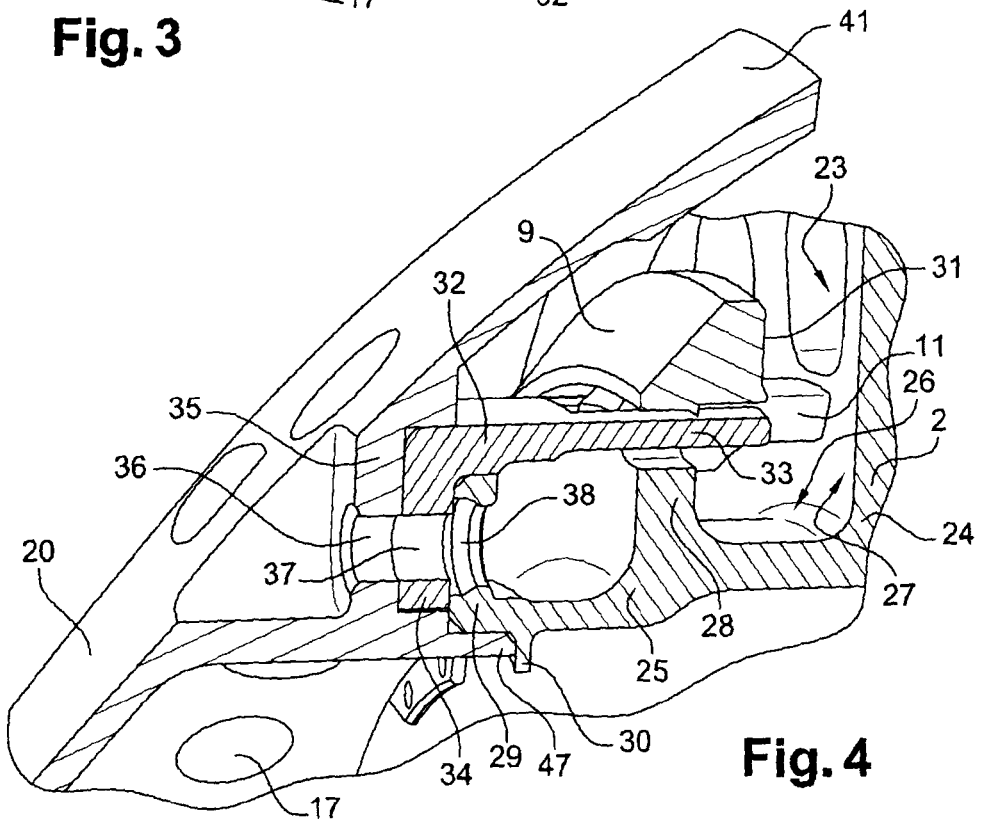
Figure 5:
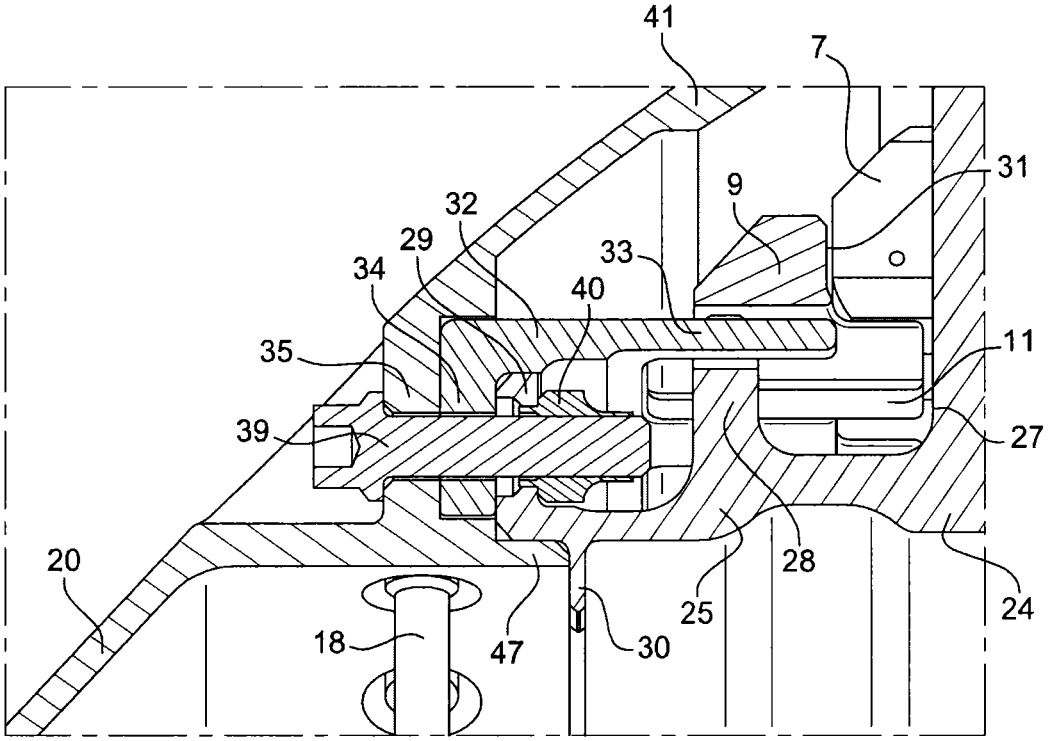
FIG. 5 is a section view of a portion of the fan rotor of the invention, showing a bolt for fastening the cap on the disk.

Reference is made initially to FIGS. 1 and 2, which show a turbine engine fan of the art prior to the present invention.

The fan comprises blades 1 carried by a disk 2 with interblade platforms 3 interposed between the blades, the disk 2 being fastened to the front end of a shaft 4 of the engine.

Each fan blade 1 comprises an airfoil 5 connected at its radially inner end to a root 6 that is engaged in a substantially axial slot of complementary shape in the disk 2, thereby enabling the blade 1 to be held radially on the disk 2. A spacer 7 is interposed between the root 6 of each blade 1 and the bottom of the corresponding groove in the disk 2 in order to prevent the blade 1 from moving radially relative to the disk 2.

The interblade platforms 3 form a wall that defines the inside of the passage for the stream of air entering into the engine, and they comprise means that co-operate with corresponding means provided on the disk 2 between the slots for fastening the platforms 3 on the disk 2.

The fan blades 1 are held axially in the slots of the disk 2 by appropriate means mounted on the disk 2, upstream and downstream from the blades 1.

The retaining means situated downstream comprise a hook 8 engaged in a notch formed by machining in a downstream end portion, referred to as a "stub", of the root 6 of each blade 1.

The retaining means that are situated upstream comprise a ring 9 and an annular plate 10 fitted on the upstream end of the disk 2 and fastened coaxially thereto.

The ring 9 (FIG. 2) has an inner annular bead 11 that is festooned or crenellated and that co-operates with a crenellated or festooned outer annular bead 12 of the disk in order to hold the ring 9 axially in position on the disk 2. The ring 9 bears via its outer periphery on the spacers 4 of the blade roots.

The plate 10 extends upstream of the ring 9 and of the root 6 of the fan blades 1. This plate 10 includes pegs (not visible) at its outer periphery for attaching the upstream ends of the interblade platforms 3.

The plate 10 also includes an inner annular flange 13 that is interposed between a corresponding annular flange 14 of the disk 2 and an inner annular flange 15 of a shroud 16 arranged upstream from the fan disk 2. The flanges 13, 14, 15 include axial orifices for passing bolts or the like (not shown) enabling the flanges to be clamped together.

The shroud 16 is substantially frustoconical in shape, flaring downstream, the wall defined by the interblade platforms 3 extending the shroud 16 axially. The shroud 16 has radial holes 17 for mounting balancing screws 18 together with a flange 19 situated at its upstream end. A cap 20 (FIG. 1) of conical shape is mounted on the upstream portion of the shroud 16. More particularly, the cap has a flange 21 at its downstream end, which cap is fastened to the upstream flange 19 of the shroud 16 by bolts 22 that are situated radially inside the fastener bolts (not shown) for fastening the shroud 16 on the disk 2.

Such a structure presents the drawbacks as described above. In particular, it is not appropriate for a fan of relatively small diameter.

FIGS. 3 to 8 show an embodiment of a turbine rotor of the invention comprising, in the same manner as described above, a disk 2 carrying blades having their roots (not shown) engaged in substantially axial slots 23 in the outer periphery of the disk 2, spacers 7 (visible only in FIGS. 5 and 6) being mounted between the blade roots and the bottoms of the slots 23.

The disk has an annular rim 24 without balance weights that is extended upstream by an annular portion 25 including an annular groove 26 defined between an upstream face 27 of the rim 24 and a radial bead 28 extending outwards. The upstream end of the annular portion 25 includes a flange 29 extending radially outwards and spaced apart from the bead 28, abutments 30 extending radially inwards also being situated between the bead 28 and the flange 29.

The bead 28 is festooned or crenellated and comprises solid portions alternating with hollow portions. The flange 29 has holes that are regularly distributed all around its circumference.

The fan rotor is fitted with axial retaining means for retaining the blades upstream on the disk 2. These means comprise a ring 9 mounted in the annular groove 26 of the disk 2 and forming an abutment for the blade roots.

The ring 9 is festooned or crenellated at its inner periphery 11 and comprises solid portions alternating with hollow portions, which portions are substantially complementary in shape to the portions of the bead 28 in order to allow the ring 8 to be put into place and removed by being moved axially in translation.

The ring 9 has an annular shoulder 31 at its outer periphery serving as an abutment for the spacers 7 so as to prevent the blade roots from moving upstream.

Finally, the ring 9 has an annular recess opening out upstream and housing the bead 28 of the disk 2.

The ring 9 is prevented from turning by means of an annulus 32 having axial teeth 33 inserted in the hollow portions of the bead 28 of the disk 2 and of the ring 9. The upstream edge of the annulus 32 has lugs 34 extending radially inwards, which lugs are formed with bolt-passing holes. The annulus 32 is made of high alloy steel, so as to be able to withstand being torn away. The ring 9 is prevented from moving in rotation by its solid portions coming into abutment against the teeth 33 of the annulus 32.

A cap 20, e.g. made of aluminum and conical in shape, is fastened on the disk 22. For this purpose, in its middle portion, the cap 20 has an inner annular bead 35 having through axial holes 36 formed therein (FIG. 4) situated facing some of the holes 37 in the annulus and some of the holes 38 in the flange 29 of the disk 2. These holes 36, 37, 38 pass bolts 39 (FIG. 5) co-operating with nuts 40 housed in an annular groove of the portion 25 of the disk and enabling the cap 20, the annulus 32, and the disk 2 to be fastened together. The downstream portion 41 of the cap 20 covers the annulus 32 and the ring 9 so that the inner passage as defined by the interblade platforms axially extends the downstream portion 41 of the cap 20.

Figure 6:
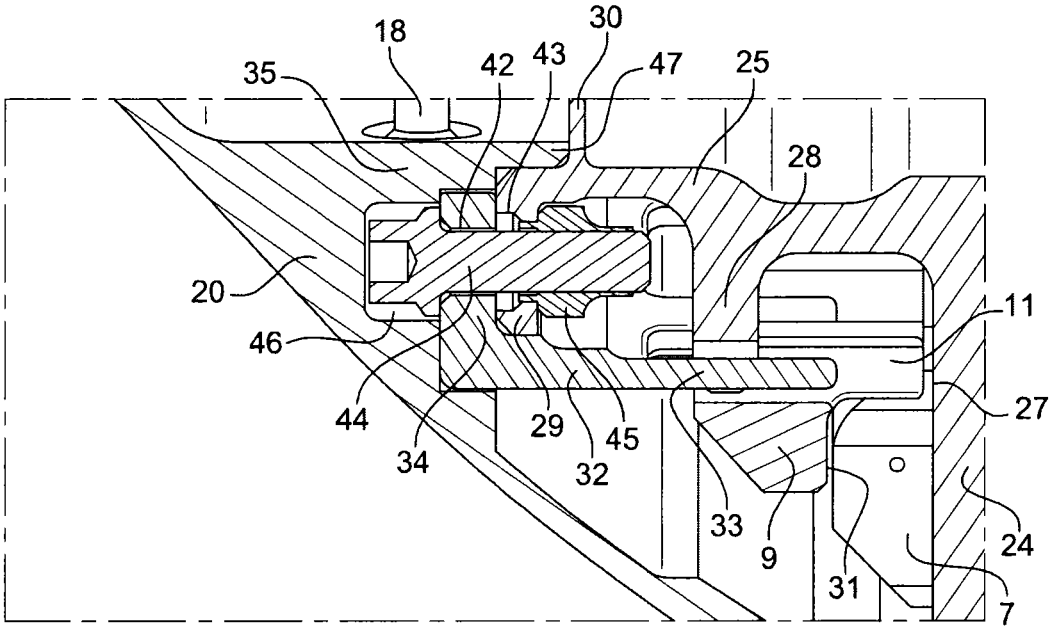
FIG. 6 is a view corresponding to FIG. 5, showing a bolt for fastening the ring on the disk.

As can be seen in FIG. 6, other holes 42 in the annulus 32, situated in register with other holes 43 in the flange 29 of the disk 2, pass bolts 44 that co-operate with nuts 45 and that serve solely for fastening the annulus 32 on the disk 2. The heads of these bolts 44 are housed in blind holes 46 formed in the inner bead 35 of the cap 20.

The inner bead 35 of the cap 20 also includes a cylindrical collar 47 that extends upstream, with the end of the collar coming to bear against the abutments 30.

Figure 7:
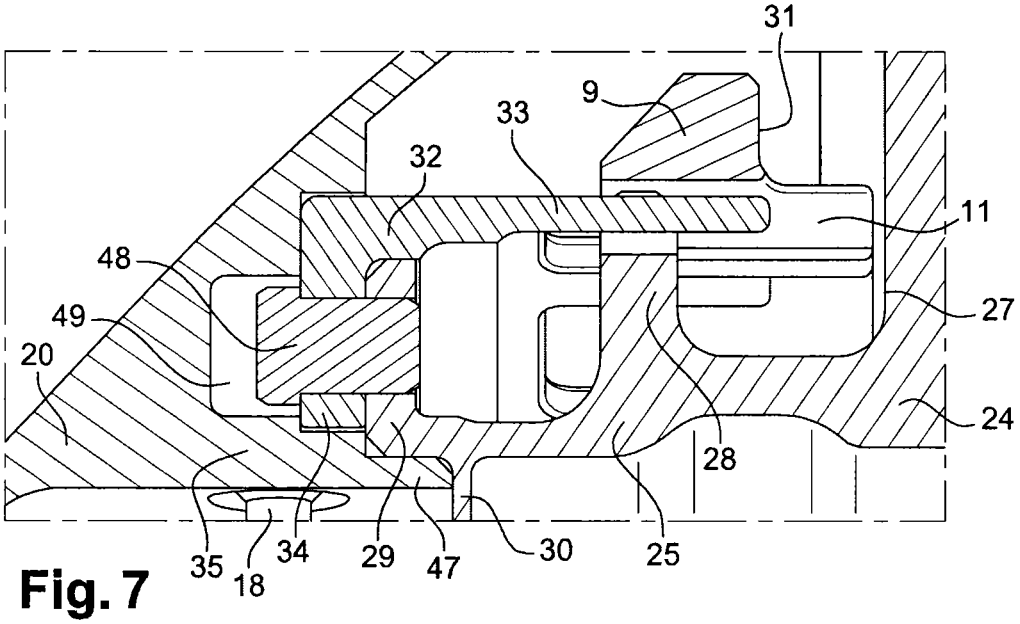
FIG. 7 is a section view of a portion of the fan rotor of the invention, showing an indexing peg.

The cap 20 also includes radial tapping 17 for mounting balance screws 18, as is well known in the prior art. In order to guarantee that these screws 18 are properly positioned, it is necessary to index the position of the cap 20 relative to the fan rotor. For this purpose, and as shown in FIG. 7, an indexing peg 48 is mounted in the aligned holes in the annulus 32 and in the flange 29 of the disk 2. The peg 48 has a head received in a blind hole 49 in the inner bead 35 of the cap 20, the diameter of the head of the peg 48 being determined so that it cannot be inserted in another blind hole 46 provided for receiving the heads of the bolts 44.

Figure 8:
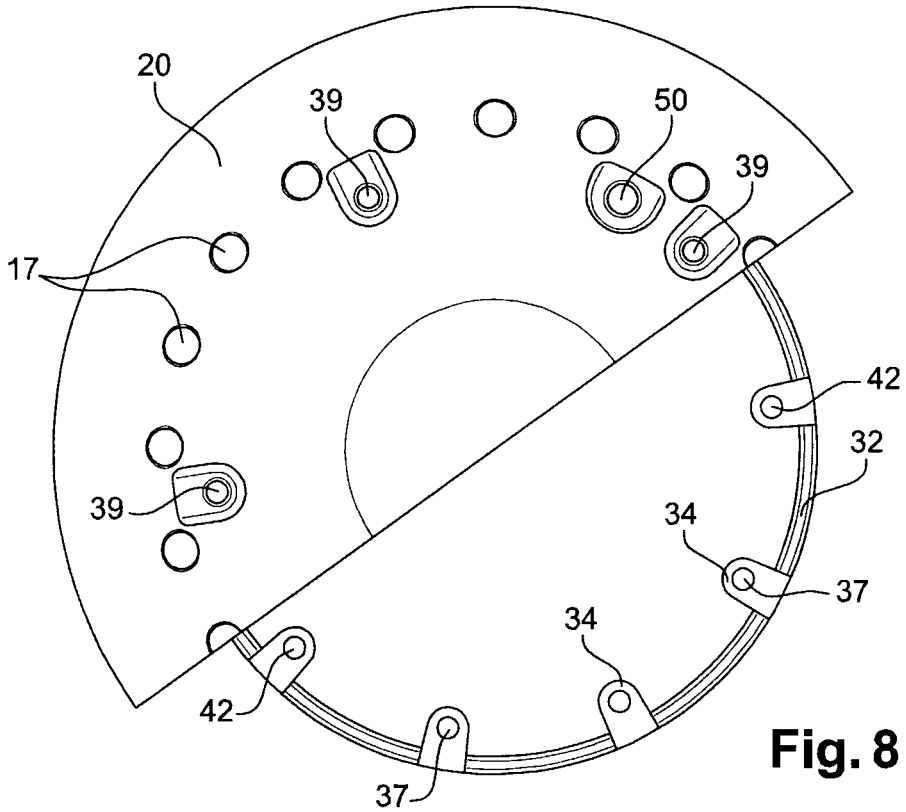
FIG. 8 is a partially cutaway front view of the cap and of the ring.

The inner bead 35 of the cap 20 also has two through axial holes that are tapped (FIG. 8) for passing extractor screws 50 for extracting the cap 20 (FIG. 8).

The invention thus provides a fan rotor that is compact in the radial direction. As mentioned above, the bolts 39 used for fastening the cap 20 on the disk 2, and the bolts 44 used for fastening the annulus 32 on the disk 2 are situated substantially on the same diameter, such that the radial size of the assembly is reduced. A central space of sufficient size can thus be freed in order to facilitate access to the nut for fastening the disk on the engine shaft.

Furthermore, in the event of the cap 20 being torn off, there is no accidental ejection of a blade. The cap 20 being torn off cannot lead to the annulus 32 being separated from the disk 2.

The invention claimed is:

1. A fan rotor comprising:

a disk carrying blades including roots engaged in substantially axial slots in an outer periphery of the disk;

a substantially frustoconical cap mounted on the disk upstream from the blades;

retaining means for axially retaining the blades on the disk and comprising a ring mounted in an annular groove of the disk and forming an abutment for the roots of the blades, the ring being festooned or crenellated and co-operating with a festooned radial annular bead of the annular groove of the disk; and means for preventing the ring from moving in rotation, which means comprises an annulus carrying at least one axial tooth inserted in hollow portions of the bead of the disk and of the ring, the annulus being fastened by bolts on an upstream radial face of the disk;

wherein the annulus includes lugs extending radially inwards and including holes passing axial bolts for fastening the annulus on the disk, the cap being fastened on the disk by axial bolts passing through the holes in some of the lugs of the annulus, and further comprising an indexing peg mounted in aligned holes in the annulus and in the disk and including an upstream head received in a blind hole in an inner radial bead of the cap.

2. A fan rotor according to claim 1, wherein, in its middle portion, the cap includes an inner annular bead including both blind axial holes formed therein that open out downstream and that serve as housings for heads of the bolts for fastening the annulus on the disk, and through axial holes for passing bolts for fastening the cap on the disk.

3. A fan rotor according to claim 2, wherein the inner radial bead of the cap includes two through axial holes that are tapped for passing extractor screws.

4. A fan rotor according to claim 1, wherein the cap is made of light metal, or of aluminum, and the annulus is made of metal that withstands being torn away, or high alloy steel.

5. A turbojet, comprising a fan rotor according to claim 1.

* * * * *